US006666444B1

(12) United States Patent
Paoli

(10) Patent No.: US 6,666,444 B1
(45) Date of Patent: Dec. 23, 2003

(54) SHEET SET COMPILING SYSTEM WITH DUAL MODE SET EJECTION AND FIRST SHEET FEEDING AND REVERSAL

(75) Inventor: Giuseppe Paoli, Toronto (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/307,038

(22) Filed: Nov. 27, 2002

(51) Int. Cl.[7] ..... B65H 31/34

(52) U.S. Cl. ..... 270/58.11; 270/58.08; 270/58.14; 270/58.13; 399/410

(58) Field of Search ..... 270/58.08, 58.11, 270/58.13, 58.14; 399/410

(56) References Cited

U.S. PATENT DOCUMENTS 5,021,837 A * 6/1991 Uto et al. ..... 399/405
5,098,074 A 3/1992 Mandel et al.
5,289,251 A 2/1994 Mandel et al.
5,342,034 A 8/1994 Mandel et al.
5,473,420 A 12/1995 Rizzolo et al.
5,478,061 A * 12/1995 Murakami et al. ..... 270/58.08
5,480,130 A * 1/1996 Suzuki et al. ..... 270/58.11
5,765,824 A * 6/1998 Kawano et al. ..... 270/58.11
H1781 H 2/1999 Mandel et al.
6,120,020 A * 9/2000 Asao ..... 271/189
6,290,220 B1 * 9/2001 Takehara et al. ..... 270/58.12
6,305,681 B1 * 10/2001 Watanabe et al. ..... 270/58.08
6,427,997 B1 * 8/2002 Hirota et al. ..... 270/58.12
6,601,840 B2 * 8/2003 Boss et al. ..... 270/58.08

* cited by examiner

*Primary Examiner*—Patrick Mackey

(57) ABSTRACT

An integrated sheet compiler/stacker system with reduced sheet roll-over or other jam problems, especially where the stacker is an elevator stacking tray or mailbox bin which moves relative to the compiler, with a gap therebetween, and partially shares the sheet set compiling area. For the first sheet of a set being compiled, a dual mode compiler set eject drive roller nips system is closed and that first sheet lead edge area is fed thereby partially out of the compiler towards the adjacent stacker tray or mailbox bin, with improved corrugated and/or more planer sheet extension support. Then that first sheet is reverse fed back into the compiler for positive compiling. Those set eject nips are opened for the compiling of the subsequent sheets of that same set (for which the first sheet provides a smooth gap bridge), then they close again to eject the entire compiled set and receive the first sheet of the next set.

4 Claims, 5 Drawing Sheets

SHEET SET COMPILING SYSTEM WITH DUAL MODE SET EJECTION AND FIRST SHEET FEEDING AND REVERSAL

In reproduction systems, such as xerographic or other printers, it is often desirable to automatically compile each printed sheet of plural sheet documents in a collated and neatly superposed set, and then eject and stack such collated sets in an adjacent output tray or bin, with or without set stapling or other finishing, and/or with sets off-setting. Some examples are shown in Xerox Corp. U.S. Pat. Nos. 5,289,251 issued Feb. 22, 1994; 5,342,034 issued Aug. 30, 1994; and Xerox Corp. U.S. Statutory Invention Registration (SIR) No. H1781 published Feb. 2, 1999.

It may also be desirable in some situations for such printer output systems to reduce overall floor space or "machine footprint." Thus partial sharing of the set compiling and set stacking areas and functions may be optionally provided, such as also taught in Xerox Corp. U.S. Pat. No. 5,098,074 issued Mar. 24, 1992, or similar known systems in which the compiled sets are then fully ejected from the compiler tray by closing an open nip to engage driven sheet feeding rollers with mating idlers. Other compiling systems are cited in the above-cited patent publications.

In prior compiler/stacker systems such as those cited above, an exit feed nip providing the set ejection is typically held open during the compiling of all of the sheets of the set of sheets being compiled, especially if part of the sheets may stick out of the compiler during compiling, such in the type of system of the above-cited U.S. Pat. No. 5,098,074, or the like.

Of particular interest as an example of such exemplary prior art compiler/stacker systems is Xerox Corp. U.S. Pat. No. 5,473,420 issued Dec. 5, 1995, especially its following description in col. 6, lines 4–12. "The completed attached set can then be driven out of the tray 90 by set ejector driver rolls 109, 110 which come together to clamp the compiled set and move it onto the stacking tray 90." This typifies such prior systems in which the exit feed nip only closes after the set is fully compiled and stapled, to eject the entire compiled set fully out of the compiler onto an adjacent or downstream elevator or fixed stacking tray (or similarly into a selected "mailbox" bin, as in the above-cited U.S. Pat. No. 5,342,034 and SIR).

In contrast, the system of the specific disclosed embodiment further described below ejects the first sheet of each set being compiled partially out of the compiler system in an unusual way. When the first sheet of a set arrives at the compiler the compiler set eject drive roller nip system is closed, unlike the above-cited systems, and that first sheet's lead area is fed partially out of the compiler downstream via the set eject drive rolls until the trail edge of that first sheet clears the compiler drive belt(s). At that point the rotation of the still-closed set eject drive rollers is reversed, by reversing their drive motor, to positively drive that first single sheet backwards (upstream) back into the compiler, under the compiler drive belt(s), to feed up against the compiler tray backstop. During or after that movement the set eject system nips are opened. The set eject nips can then remain open for the compiling of the rest of the set, and then close again to eject the compiled set and then to receive the first sheet of the next set to be compiled.

That is, the dual mode system of the disclosed embodiment uses the set eject system as an improved and more positive compiling drive system for the first sheet as well as providing for ejection of the completed set. It can also provides advantages in desensitizing sheet curl and/or making less critical the stacking tray angle, for reduced sheet jams or misstacking. This is particularly so where part of the stacking tray acts as supporting bridge for the compiling of the downstream end of the first sheet, especially for long sheets, as discussed above in connection with that cited art.

Further in that regard, finishing devices typically have a compiling technology that is sensitive to sheet curl. For mailbox systems, for example, the above-cited SIR No. H1781, since the mailbox bins or trays are typically not movable, the selected mailbox tray may even be misslocated at a distance vertically spaced from the exit point of the sheet from the compiler tray. Excessive curl generated by the printer may create what is usually called a completely curled over sheet lead edge or "roll over sheet," preventing proper collating or stacking of that or subsequent sheets. The typical consequence of such a "roll over sheet" is that the next sheet of the set will jam, creating a printer or finisher shut down.

Problems with the compiling or stacking of curled sheets are greatly exacerbated by the typical space or gap between the downstream end of the compiler tray and the upstream end of the adjacent stacking tray or mailbox bin. That gap is unavoidable where the stacking tray is a typical vertically movable or elevator type stacking tray which must move down relative to the compiler output as it fills with multiple stacked sets from the compiler. Or, where a compiler unit must move vertically relative to plural mailbox bins, as in the above-cited and other references. A curled lead edge sheet can catch in this gap or stub on the entrance to the stacking tray, or stub on the upstream edge of a previously stacked set on the stacking tray.

A specific feature of the specific embodiment disclosed herein is to provide a method of compiling sets of plural printed sheets, and stacking plural said compiled sets, with an integral coupler/stacker system in which part of the plural sheets being compiled extend partially out of the compiler into the stacker, and in which a set eject system closes to eject compiled sets out of the compiler onto the stacker after they are fully compiled, the improvement comprising additionally closing said set eject system for the first sheet of a sheet set being compiled, feeding said sheet partially out onto said stacker with said set eject system, reverse feeding said first sheet of said set back into said compiler for compiling, opening said set ejection system for the subsequent sheets of said set, and closing said set ejection system again after said set is compiled for feeding said compiled set out of said compiler onto said stacker.

Further specific features disclosed in the embodiment herein, individually or in combination, include those wherein said set eject system comprises openable nip reversibly rotatably driven sheet feeding rollers in said compiler positioned adjacent to said stacker; and/or wherein said stacker is moveable relative to said compiler, with a gap therebetween, and said gap is covered by said first sheet of said set; and/or wherein said stacker is adapted to move relative to said compiler with a gap therebetween, said stacker is adjacent to said compiler and provides an extended sheet set compiling area for said compiler, said compiler is adapted to compile plural printed sheets into compiled sets of plural said sheets with part of said plural sheets being compiled extending partially out of said compiler into said stacker, said compiler further including a set eject system which closes to eject compiled sets out of the compiler onto the stacker after they are fully compiled, said set eject system comprising a selectably openable and closable dual mode sheet eject drive roller nips system adjacent to said stacker which automatically closes on the first sheet of a set being compiled to feed that first sheet partially out of said compiler towards said adjacent stacker to form a bridge over said gap between said stacker and said compiler, said selectably openable and closable dual mode sheet eject drive roller nips system being automatically reversible to reverse feed said first sheet set back into said compiler for positive compiling while retaining said bridge over said gap between said stacker and said compiler, said selectably openable and closable dual mode sheet eject drive roller nips system being automatically opened for the compiling of the subsequent sheets of that same set, and said selectably openable and closable dual mode sheet eject drive roller nips system being automatically closed again to eject an entire compiled set and receive said first sheet of the next set.

The disclosed system may be operated and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy." A "print job" is normally a set of related sheets, usually one or more collated copy sets of printed sheets copied from a set of original document sheets or electronic document page images, from a particular user, or otherwise related. The terms nip and nips (plural) are used interchangeably herein because it will be well understood by those skilled in the art that there may be one, or more than one, mating drive rollers and idlers on the same shaft forming an effectively common nip. The term stacker as used herein broadly encompasses various elevator stacking trays or a stacking bin of a plural mailbox bins systems.

As to specific exemplary components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuation's, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, the present invention will be better understood from this description of this specific embodiment, including the drawing figures (which are approximately to scale) wherein:

Figure 1:
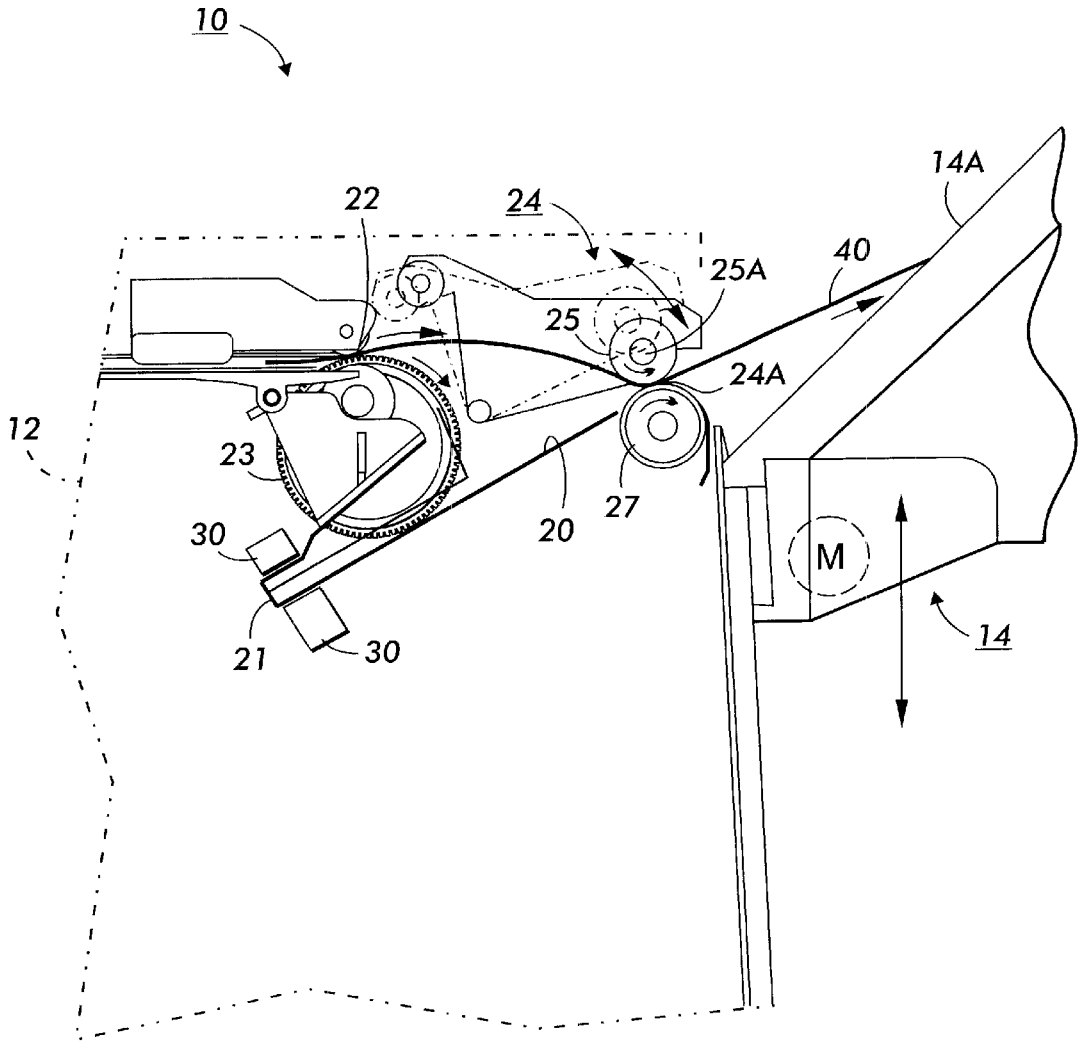
FIG. 1 is a partially schematic frontal view of one example of an improved set sets compiler/stacker unit or system for the output of a reproduction apparatus, showing the operating position thereof for an incoming first sheet of a sheet set to be compiled.

Describing now in further detail this illustrated exemplary embodiment, with reference to the FIGS., there is shown sheet compiler unit 10 conventionally receiving the sequential printed sheets output of a reproduction machine 12. In this example, as in cited art above, the compiler 10 is directly adjacent to and partially shares sheet support for sheet set compiling with a sheet stacking system 14. That sheet stacking system 14 then also provides support of stacks of fully compiled sets fully ejected from the compiler 10. In this example the sheet stacking system 14 is a conventional elevator type stacking tray unit with a stacking tray 14A which is automatically moved down by a motor M as the sets of ejected compiled sheets accumulate thereon. The stacking system 14 and the compiler unit 10 from a cooperative compiler/stacker unit in which sheets may be compiled while partially extending onto the tray 14A, as described in detail in the above cited references and known in the art, and hence not requiring repetition here.

The compiler unit 10 here, as in the above-cited references, includes a sloping sheet compiling tray or shelf 20, with a sheets end stop 21 against which the ends of sheets may be registered or aligned with the compiling assistance of a compiler drive 22 which is rotatably driving a large floppy rubber belt 23 which can flex to accommodate various sizes of sheet sets (different numbers and thickness' of sheets being compiled). Again, this is known in the art and explained in above-cited patents.

The compiler 10 here and in the above-cited art may further desirably comprise an otherwise conventional set ejection system 24 with a nip 24A formed between a driven roller set 25 and mating idlers 27, which nip 24A is normally opened by the rollers 25 being commonly mounted on a drive axle or shaft 25A which in turn is mounted on pivotal arm 26. The arm 26 is lifted to open the set ejection system 24 nip 24A, and lowered to close the nip, as shown in the respective FIGS. In a conventional such compiler unit, the set ejection system 24 would be open and inoperative until the full set of sheets was compiled in the tray 20. Also, in a conventional set ejection system, the driven set ejection rollers, such as 25, here would only be driven in one direction to drive the set downstream.

In this particular illustrated example the set ejection system has the driven roller set 25 above and the and mating idlers 27 below, to form the set ejection nip 24A. However, it will be appreciated that those components may well be reversed, with the driven rollers being positioned below the compiled set in the position of the idlers 27.

A compiled set of sheets may also be stapled together in the tray 20 by a stapler 30, if stapling is desired and selected for that set. This may be conventionally done before set ejection by the set ejection system 24, as shown in the cited patents.

Figure 2:
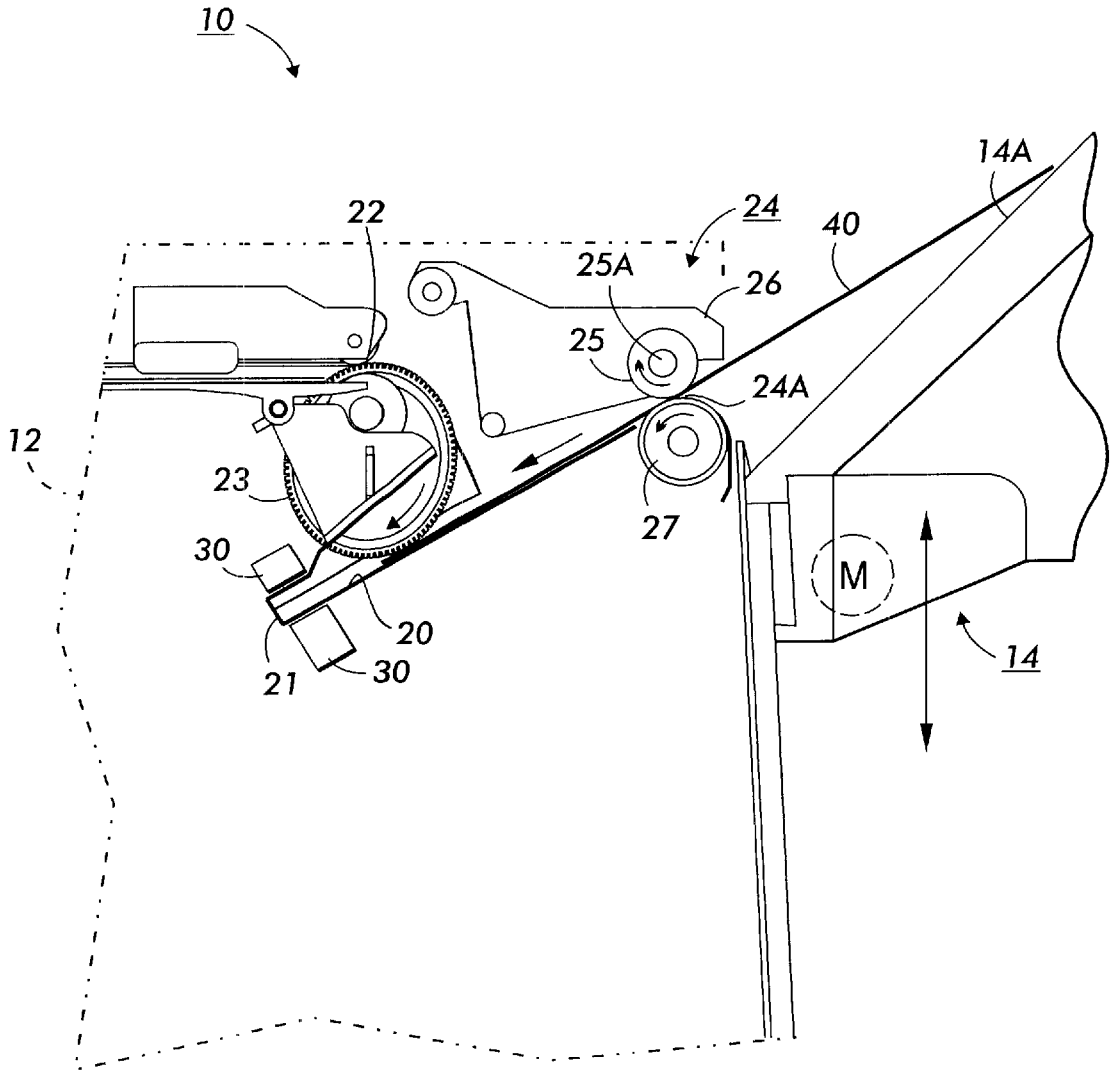
FIG. 2 illustrates the same exemplary system of FIG. 1, in a subsequent operating position for that incoming first sheet.

In contrast to the cited art, the disclosed embodiment can help prevent the previously-described problems with prior art compiler/stacker units by closing the compiler 10 eject system 24 before compiling, so that the plural eject nips 24A from the plural rollers 25 on shaft 25A close and engage and positively feed the first sheet 40 partially out of the compiler onto the tray 14A, as shown in FIG. 1. Then, as shown in FIG. 2, by reversing the eject drive shaft 25A with the nips 24A still closed, and the first sheet 40 still in the nips, the nips 24A positively reverse drive the first sheet 40 back into the compiler 10 and under the compiler belt or belts 23 before opening the eject nip(s) 24A at that point.

In part because of the corrugation in the first sheet 40 when the eject nips 24A are kept closed on that first sheet 40, and also because of the much further downstream nip engagement of the eject nip on that sheet as compared to the feed-in drive 22, any curl in the first sheet 40 is largely suppressed, and sheet roll-overs and/or sheet lead edge stubbing in the gap 14B between the compiler and the stacker tray 14A are much less likely to happen.

Figure 3:
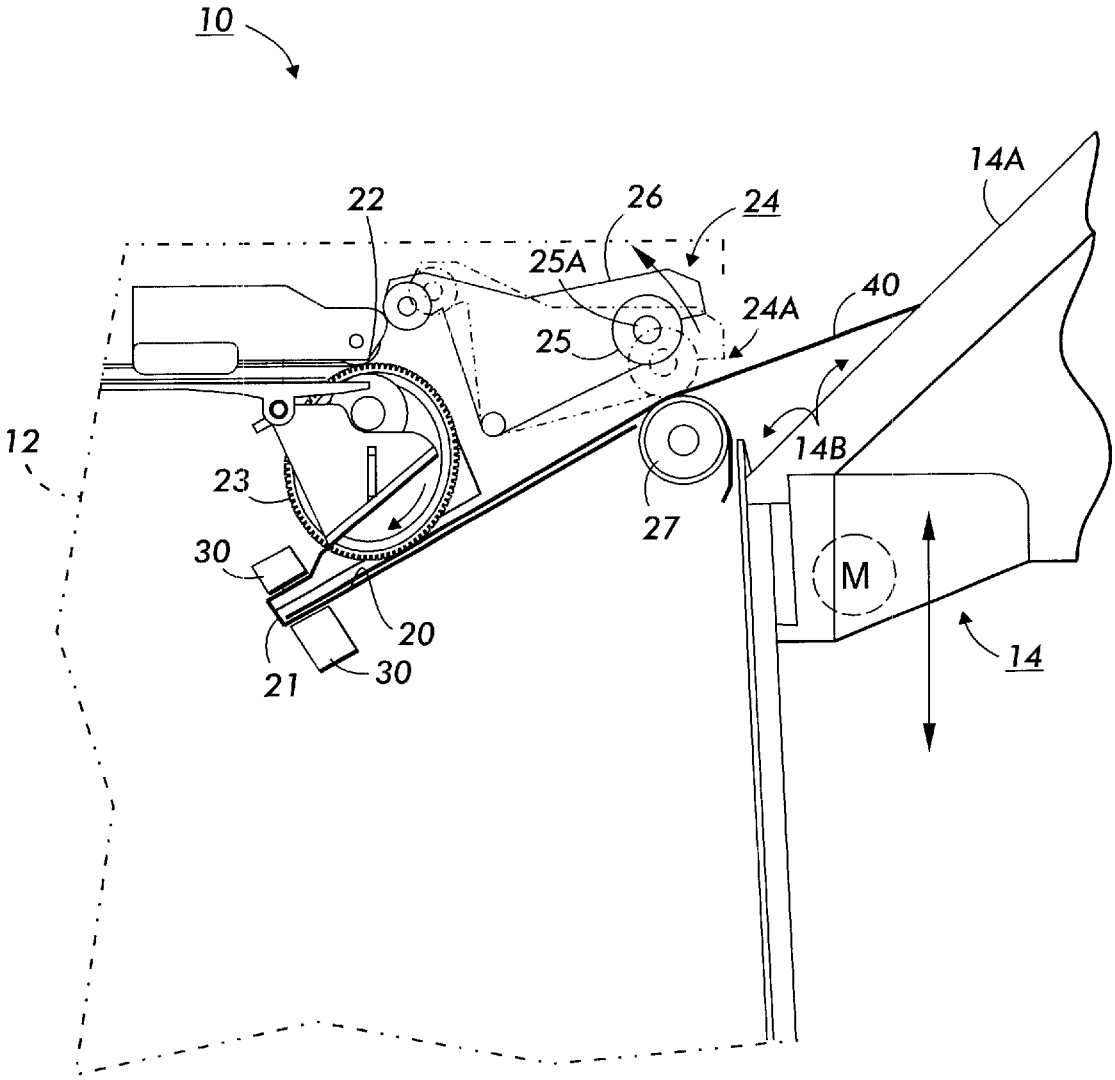
FIG. 3 illustrates the same exemplary system of FIG. 1, in a further subsequent operating position.
Figure 4:
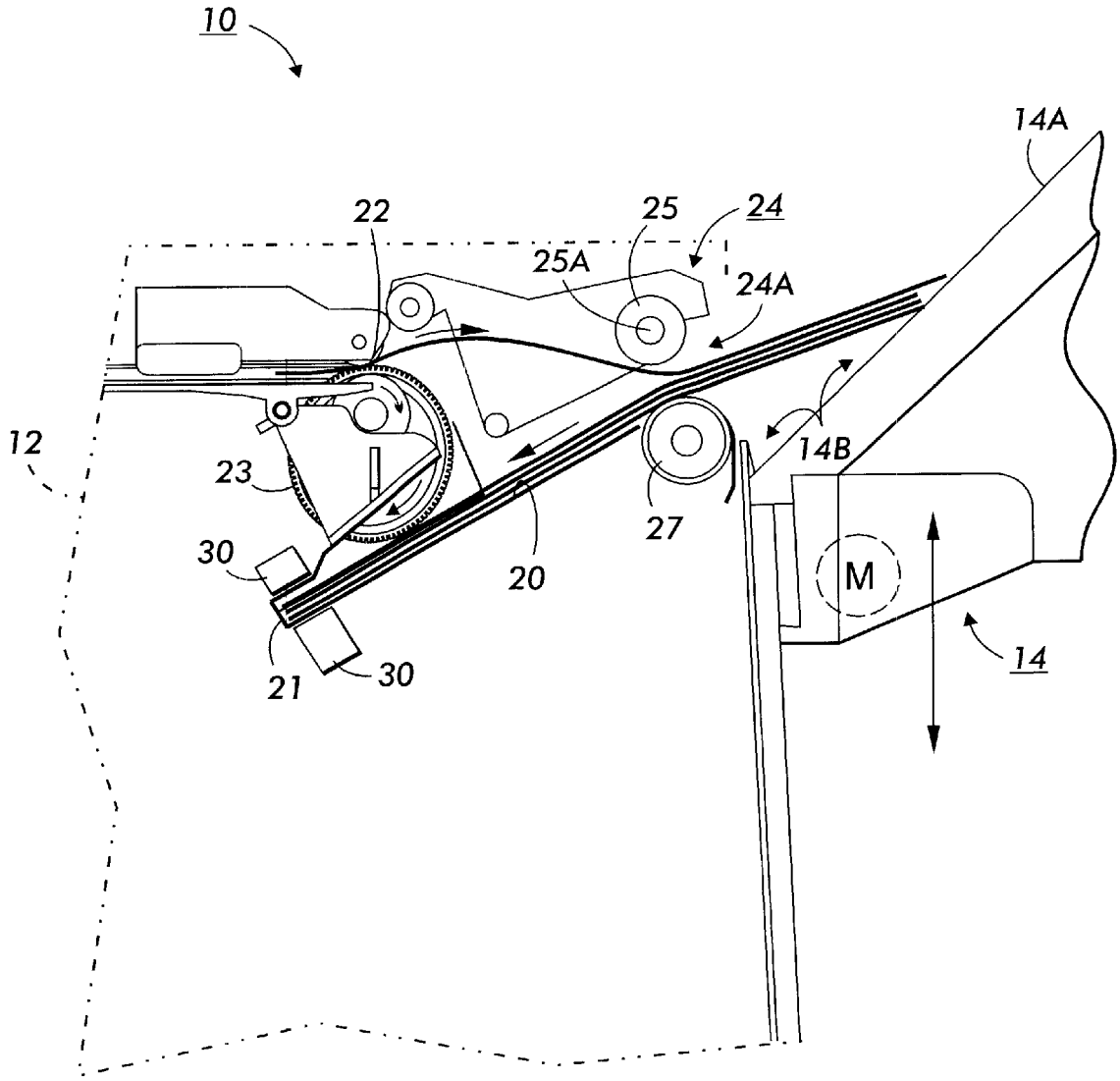
FIG. 4 illustrates the same exemplary system of FIG. 1, in a further subsequent operating position for compiling of subsequent sheets of a set being compiled.

After the first sheet 40 is so fed and compiled, it may be seen in FIG. 3 for example that a relatively smooth bridge is created by the first sheet 40 extending over the gap 14B between the compiler and the output tray. The eject system nips 24A can be held opened for the compiling of the rest of the sheets of the set on top of the sheet 40, as illustrated in FIG. 4. The first sheet 40 covers the above-discussed gap 14B or the like between the compiler and the stacker (the stacking tray or mailbox bin) and provides a smooth transition guide surface for the lead edge of the next or subsequent sheet to prevent the above-discussed stubbing of that sheet, and so that those following sheets may all reliably conventionally slide back down by gravity into the compiler 10 under the compiler belt or belts 23 due to the downward slope of the compiler tray 20 and stacking tray 14A.

Thus, the compiler set eject system 24 feeding nips 24A close by movement of the arm 26 to drive the first sheet 40 partially out, and to then reverse-feed that same sheet 40 and then the nips open. The nips 24A of the set eject system 24 then stay opened until the last sheet of the set is compiled, and then close again to eject the compiled set of sheets.

That is, in the embodiment herein, the first sheet handling or routing of each set of sheets being compiled is significantly modified. A carriage exit shaft is holding the idlers 27 of the last (most downstream) nip 24A in the compiler unit 10 paper path, at the output of the compiler to the stacking tray. That compiler exit or eject nip 24A is kept closed for the first sheet 40 until that first sheet is compiled. The feed rolls 25 of that compiler eject nip are intermittently reversibly driven to feed the sheet back into the compiler and under the bottom of the large floppy compiler belts 23, after the trail edge of the sheet 40 passes a particular position, which may be conventionally optically sensed. The compiler driving nip engagement of drive roller 22 with the top of the large floppy compiling roller belt 23 always stays closed.

Figure 5:
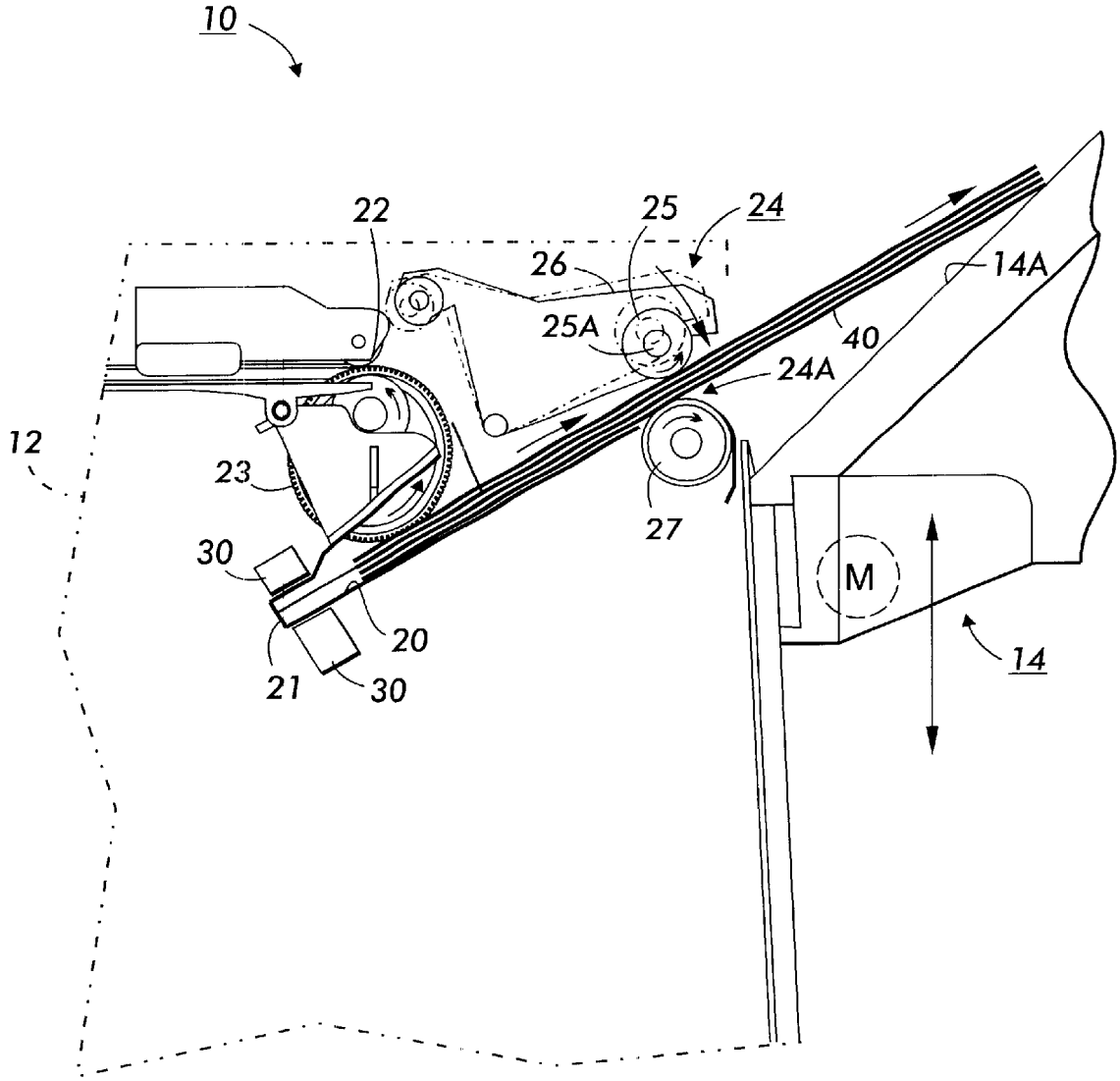
FIG. 5 illustrates the same exemplary system of FIG. 1, in a further and final subsequent operating position, with compiled set ejection onto a stack of previously compiled and stacked sets.

As noted, that exit nip 24A does not need to stay closed to reverse feed all of the rest of the sheets back to the large floppy compiling roller belt 23. Two separate motors may be respectively running the compiler belts 23 and the exit rollers 25 drive shaft 25A independently of one another. After the first sheet 40 is thus reversed and compiled, the rest of the sheets of the set may be compiled via only gravity and the compiler belts 23. If the exit drive idlers and drives are reversed, so that the exit drive shaft and its drive rollers are below, they are also now covered by the first sheet 40. That exit drive shaft need not run again (be driven) until after the stack is compiled (and stapled if desired), and the exit nip closed, to conventionally eject the entire compiled set stack fully out onto the stacking tray 14A, as shown in FIG. 5.

It will be appreciated that the exit drive roll shaft may be provided with flappers or kickers to assist sheet trail edge knockdown stacking. These are well known in various sheet ejection and stacking systems.

While the embodiment disclosed herein is presently preferred, it will be appreciated that other presently unknown or unforeseeable alternatives, modifications, variations or improvements therein may be made by those skilled in the art, which are intended to be encompassed by the following claims.

What is claimed is:

1. In a method of compiling sets of plural printed sheets, and stacking plural said compiled sets, with an integral coupler/stacker system in which part of the plural sheets being compiled extend partially out of the compiler into the stacker, and in which a set eject system closes to eject compiled sets out of the compiler onto the stacker after they are fully compiled, the improvement comprising:

additionally closing said set eject system for the first sheet of a sheet set being compiled, feeding said sheet partially out onto said stacker with said set eject system, reverse feeding said first sheet of said set back into said compiler for compiling, opening said set ejection system for the subsequent sheets of said set, and closing said set ejection system again after said set is compiled for feeding said compiled set out of said compiler onto said stacker.

2. The method of compiling sets of plural printed sheets, and stacking plural said compiled sets, with an integral coupler/stacker system, of claim 1, wherein said set eject system comprises openable nip reversibly rotatably driven sheet feeding rollers in said compiler positioned adjacent to said stacker.

3. The method of compiling sets of plural printed sheets, and stacking plural said compiled sets, with an integral coupler/stacker system, of claim 1, wherein said stacker is moveable relative to said compiler, with a gap therebetween, and said gap is covered by said first sheet of said set.

4. An integrated sheet compiler/stacker system with reduced sheet roll-over jam tendencies, wherein;

said stacker is adapted to move relative to said compiler with a gap therebetween, said stacker is adjacent to said compiler and provides an extended sheet set compiling area for said compiler, said compiler is adapted to compile plural printed sheets into compiled sets of plural said sheets with part of said plural sheets being compiled extending partially out of said compiler into said stacker, said compiler further including a set eject system which closes to eject compiled sets out of the compiler onto the stacker after they are fully compiled, said set eject system comprising a selectably openable and closable dual mode sheet eject drive roller nips system adjacent to said stacker which automatically closes on the first sheet of a set being compiled to feed that first sheet partially out of said compiler towards said adjacent stacker to form a bridge over said gap between said stacker and said compiler, said selectably openable and closable dual mode sheet eject drive roller nips system being automatically reversible to reverse feed said first sheet set back into said compiler for positive compiling while retaining said bridge over said gap between said stacker and said compiler, said selectably openable and closable dual mode sheet eject drive roller nips system being automatically opened for the compiling of the subsequent sheets of that same set, and said selectably openable and closable dual mode sheet eject drive roller nips system being automatically closed again to eject an entire compiled set and receive said first sheet of the next set.

* * * * *